United States Patent [19]

Gonterman et al.

[11] 4,261,424

[45] Apr. 14, 1981

[54] PEG AND STAKE DRIVER AND EXTRACTOR

[76] Inventors: Robert N. Gonterman, 247 S. Tekoppel Ave.; William E. Reutter, 3316 Hartmetz Ave., both of Evansville, Ind. 47712

[21] Appl. No.: 40,986

[22] Filed: May 21, 1979

[51] Int. Cl.[3] ..... B25D 1/04

[52] U.S. Cl. ..... 173/91

[58] Field of Search ..... 173/91, 90, 128–133; 29/255, 254, 275; 30/277, 164.6; 81/52.35; 145/30.5; 403/354, 348, 349; 254/19

[56] References Cited

U.S. PATENT DOCUMENTS

| | | | |
|---|---|---|---|
| 716,274 | 12/1902 | Peirce, Jr. | 173/91 X |
| 1,662,538 | 3/1938 | Richmond et al. | 173/91 X |
| 2,525,316 | 10/1950 | Schiff | 173/91 |
| 2,629,985 | 3/1953 | McDowel | 173/131 X |
| 3,096,831 | 7/1963 | Adams | 173/128 X |
| 3,381,763 | 5/1968 | Matson | 173/132 X |
| 3,511,325 | 5/1970 | Schmidt | 173/91 X |
| 3,519,087 | 7/1970 | Santi | 173/91 |
| 3,519,234 | 7/1970 | Matson | 173/91 X |
| 3,529,497 | 9/1970 | Brooks | 173/91 X |
| 3,568,657 | 3/1971 | Gue | 173/91 X |
| 3,570,289 | 3/1971 | Smyers | 173/91 X |
| 3,583,499 | 6/1971 | Cordes | 173/91 X |
| 3,651,873 | 3/1972 | Uebel et al. | 173/91 X |
| 3,735,822 | 5/1973 | Deike | 173/91 X |
| 3,823,785 | 7/1974 | Toliver | 173/128 |

*Primary Examiner*—Louis Rimrodt
*Assistant Examiner*—Andrew M. Falik
*Attorney, Agent, or Firm*—Woodard, Weikart, Emhardt & Naughton

[57] ABSTRACT

A peg and stake driver and extractor comprising a first elongate tubular member having a pair of wall projections secured thereto and a reciprocating tubular member positioned concentrically around the first member between these wall projections and having its own pair of opposing striking surfaces to forcibly contact these wall projections. The lower end of this first member includes a first longitudinal slot in the wall thereof joined to a second longitudinal slot of substantially greater width and defining opposing horizontal contact surfaces in the wall thereof. This slotted end of the first member is interlockable with the upper end of a V-shaped angle iron stake member having portions of its walls cut away to provide for the interlocking connection.

2 Claims, 8 Drawing Figures

PEG AND STAKE DRIVER AND EXTRACTOR

BACKGROUND OF THE INVENTION

This invention relates to the field of manual driving and extracting devices and, particularly, to such a device having a reciprocating striking member and an improved means for interlocking with the stake member.

It is generally known to provide tool combinations having both driving and extracting capabilities. Such tools have been around for many years and usually comprise a grippable member reciprocable along a shaft between upper and lower impact shoulders or surfaces. Many uses have developed for such devices, as for example, in the automotive area as a body working or pulling tool. See Smyers, U.S. Pat. No. 3,570,289; Richmond et al., U.S. Pat. No. 1,662,538; and Santi, U.S. Pat. No. 3,519,087.

As for other uses, Peirce, U.S. Pat. No. 716,274, discloses a combination tool useful in drilling holes into masonry whereas Brooks, U.S. Pat. No. 3,529,497, discloses such a tool useful in dowel pin removal. Deike, U.S. Pat. No. 3,735,822, and Gue, U.S. Pat. No. 3,568,657, on the other hand, disclose jack hammer and rock-breaking tools, respectively, also employing this reciprocating contact stroke operation. Matson, U.S. Pat. No. 3,519,234, discloses a combination removable post and driver of similar conception.

Still further, such devices have been used for heavy post or pole extraction as evidenced by the disclosures in Schmidt, U.S. Pat. No. 3,511,325, Uebel et al., U.S. Pat. No. 3,651,873, and Cordes, U.S. Pat No. 3,583,499.

In many of these devices, the means for gripping the workpiece is of much importance, whether it be by threaded shaft, gripping teeth or clamp, or otherwise. This is true, for example, with peg or stake driving and extracting in which a solid detachable junction is needed to eliminate slipping while maintaining stability and providing for quick and easy use in the field.

SUMMARY OF THE INVENTION

One aspect of this invention comprises a peg and stake driver and extractor having a reciprocating striking member and an improved means for interlocking with the peg or stake during use. This means includes a first and a second longitudinal slot in the tubular member adjacent its lower end and sized to permit a stake member to at least partially pass therein with forcible contact being alternately possible between the opposing contact surfaces defined by this second slot and the upper enlarged end of the stake member. The interlocking joint thereby established between the tool and stake member provides a stable and firm contact to support the driving and extracting operation.

In the preferred embodiment of applicant's invention, this stake member is an angle iron having portions of its V-shaped walls cut away near the upper end thereof for interlocking with the slotted end of the tubular member.

Related objects and advantages of the present invention will be apparent from the following description.

DESCRIPTION OF THE PREFERRED EMBODIMENTS

Figure 1:
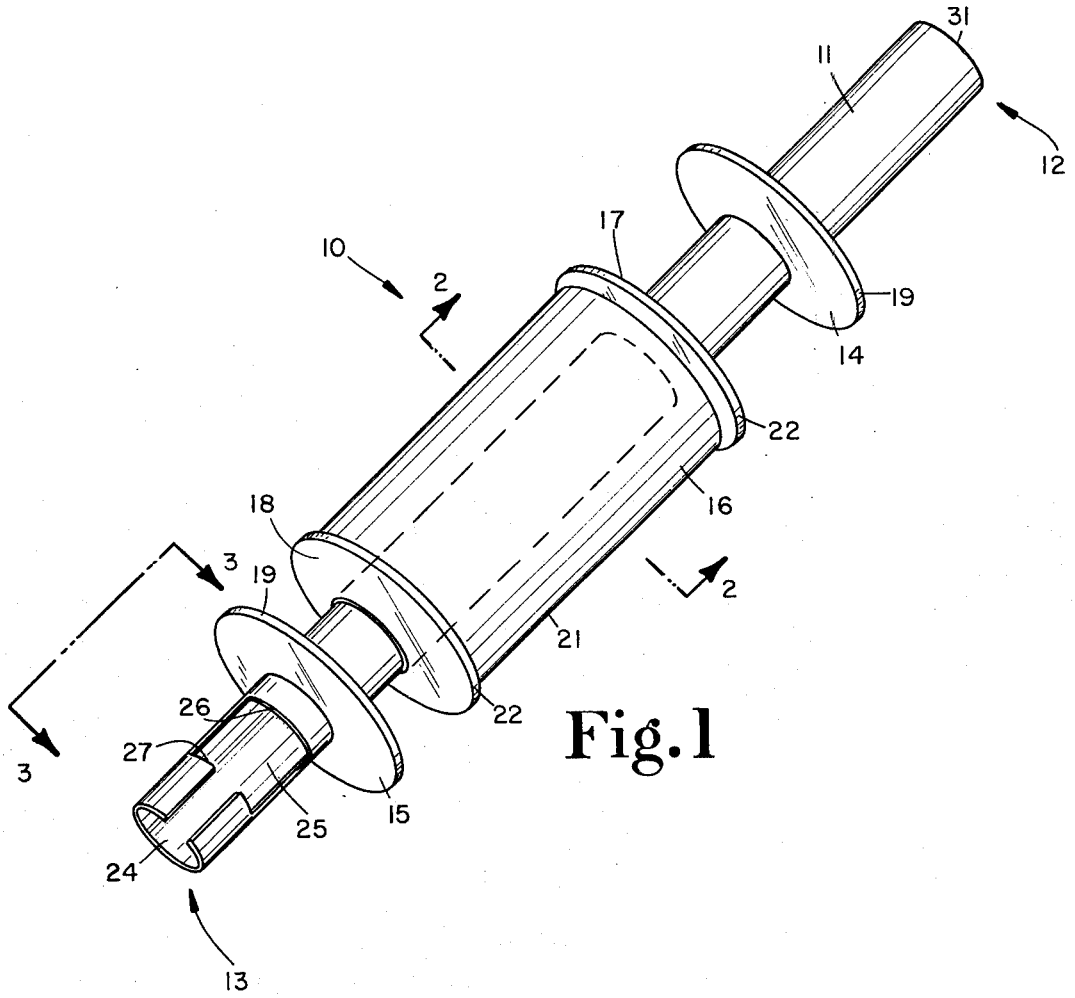
FIG. 1 is a perspective view of the peg and stake driver and extractor comprising the preferred embodiment of applicant's invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated devices, and such further applications of the principles of the invention as illustrated therein being contemplated as would normally occur to one skilled in the art to which the invention relates.

Referring now to FIG. 1, therein is depicted a peg and stake driver and extractor 10 comprising the preferred embodiment of applicant's invention. In this regard, the terms "peg" and "stake" are used herein either separately or in combination to indicate any type of implanting member having one end pointed and the other end suitable for interlocking with applicant's preferred driver and extractor by means further discussed hereinbelow.

Applicant's preferred driver and extractor 10 includes a first elongate tubular member 11 having upper and lower ends 12 and 13, respectively, and a pair of striking wall projections 14 and 15 spaced apart along its length and secured thereto. In the preferred arrangement in FIG. 1, these wall projections are metal discs 19 having central bores welded to tubular member 11 and extending radially outwardly from the tubular surface.

A reciprocating member 16 is positioned concentrically around tubular member 11 between these wall projections. Member 16 has its own pair of opposing striking surfaces 17 and 18 which are alternately used to forcibly contact the wall projections 14 and 15, respectively, to either extract or drive a stake member, as further explained hereinbelow.

Figure 2:
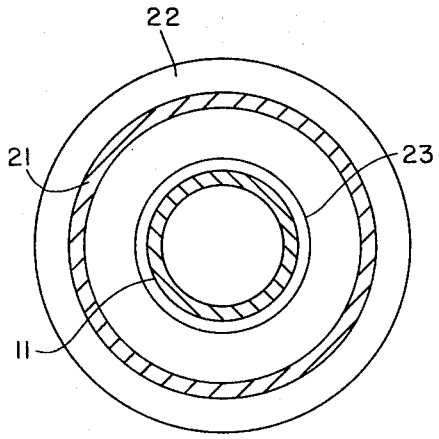
FIG. 2 is a cross-sectional view of the preferred driver and extractor in FIG. 1 taken along line 2—2.

In the preferred embodiment, this reciprocating member 16 includes a second tubular member 21 welded between two metal discs 22 similar to discs 19 except having a central bore 23 slightly larger in diameter than the outer diameter of tubular member 11, as better seen in FIG. 2. In this way, member 16 is slidable along the tubular member between the stationary wall projections.

Applicant's driver and extractor then includes means for detachably interlocking lower end 13 of the tubular member with a stake to permit driving and extracting of the stake by alternate contact between reciprocating member 16 and the wall projections 15 and 14, respectively, both actions being without slippage and with stability sufficient to provide quick and easy use in the field. In preferred driver and extractor 10, this means includes a first longitudinal slot 24 in the wall of tubular member 11 adjacent its lower end 13. This first slot joins, or opens, to a second longitudinal slot 25 in the tubular wall, this second slot being of substantially greater width and defining opposing horizontal contact surfaces 26 and 27 therein. In this regard, the structural and functional significance of the term "substantially greater width" when relating the relevant sizes of first and second slots 24 and 25 will be fully explained hereinbelow in connection with the description of applicant's preferred stake member.

Figure 3:
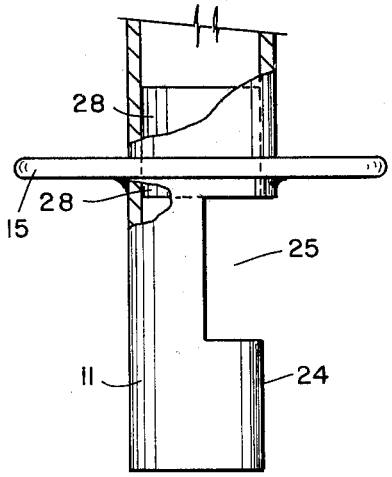
FIG. 3 is a partial side elevation of the preferred driver and extractor in FIG. 1 taken along line 3—3.

Preferred driver and extractor 10 also includes, as an optional feature, a weighted plug 28 secured to the inner surface of tubular member 11 adjacent its slotted end, as shown in FIG. 3. This weighted plug assists in forcibly driving a peg or stake interlocked in the slotted end of tubular member 11 while also preventing dirt or other debris from clogging the inside of the tubular member itself. The upper end 12 of applicant's preferred embodiment is also sealed by a welded plate 31.

Figure 4:
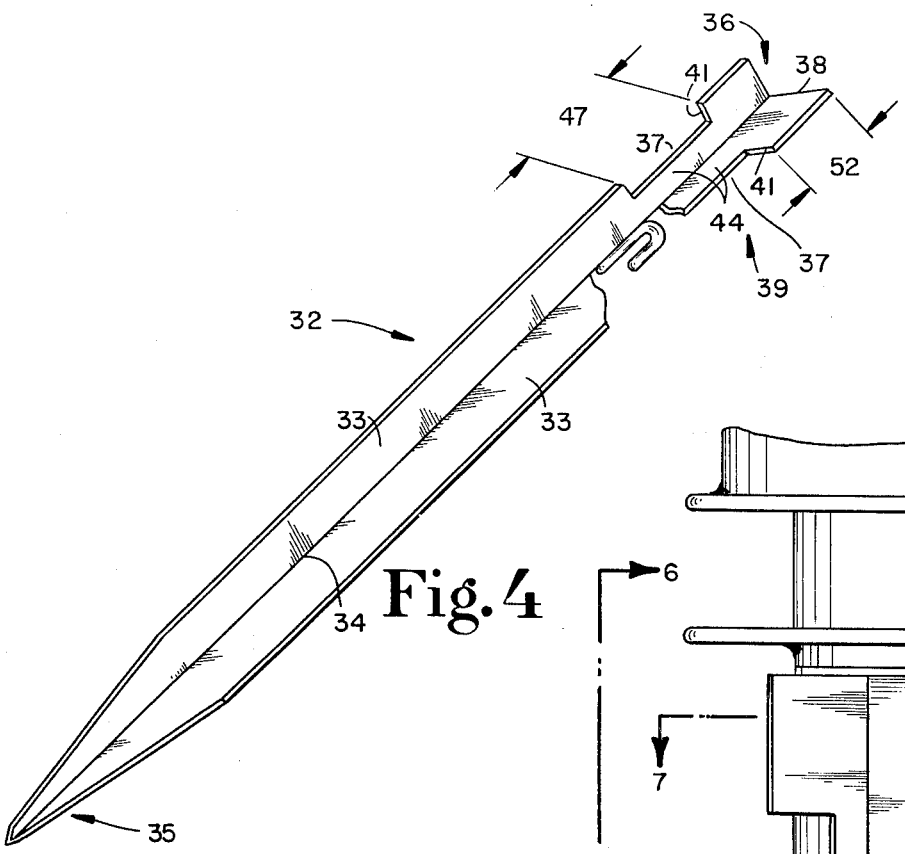
FIG. 4 is a perspective view of the preferred stake member of applicant's invention
Figure 5:
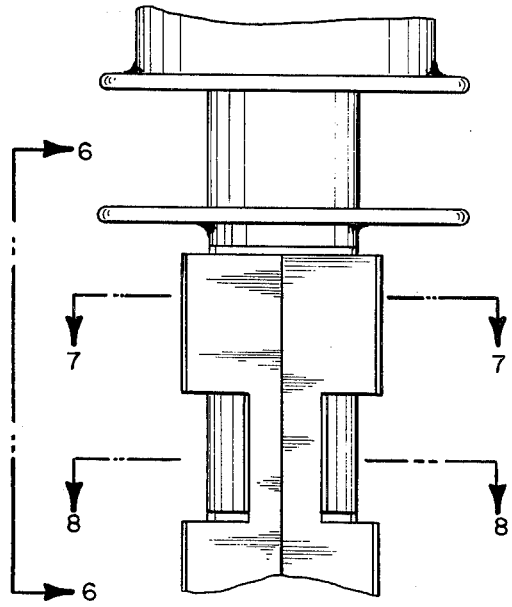
FIG. 5 is a partial front elevation of applicant's preferred driver and extractor in FIG. 1 in interlocking relation with the preferred stake member in FIG. 4.

Referring now to FIG. 4, therein is depicted applicant's preferred stake member 32. It is an elongate angle iron having two walls 33 orthogonally joined in a V-shaped configuration at a back joint, or spine, 34. Its lower end 35 is pointed for penetrating into the ground or the like. Its upper end 36 is blunt and includes means 39 for cooperatively interlocking with the slotted lower end 13 of tubular member 11 to permit driving and extracting of the stake member by alternate contact between reciprocating member 16 and the opposing pair of wall projections 15 and 14, respectively.

In applicant's preferred stake member, this means 39 includes matching cut-away portions 37 in the V-shaped walls 33 such that the larger upper end 36 of the stake member defines opposing horizontal contact surfaces 38 and 41 to alternately contact the surfaces 26 and 27, respectively, within the second longitudinal slot 25 for thereby driving or extracting the stake member.

The interlocking relationship between the lower end 13 of tubular member 11 and the upper end 36 of stake member 32 is depicted in FIGS. 5–8, as are the dimensional relationships between first and second slots 24 and 25 in the tubular member and cut-away portions 37 in the stake member. In particular, as better shown in FIG. 8, the width 42 of first slot 24 is at least slightly smaller than the width 43 separating the cut-out walls 44 of the stake member. In this way, when interlocked for driving or extracting as in FIG. 8, the cut-out walls 44 of the stake member will contact the inner wall 45 of tubular member 11 and will not easily slip through first slot 24. The length 46 of the first slot is accordingly at least slightly less than the length 47 of the cut-away portions to permit this positioning, as better shown in FIG. 6.

Figure 7:
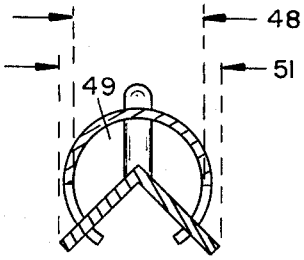
FIG. 7 is a cross-sectional view of the interlocked arrangement in FIG. 5 taken along line 7—7.
Figure 8:
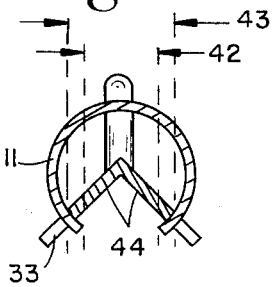
FIG. 8 is a cross-sectional view of the interlocked arrangement in FIG. 5 taken along line 8—8.
Figure 6:
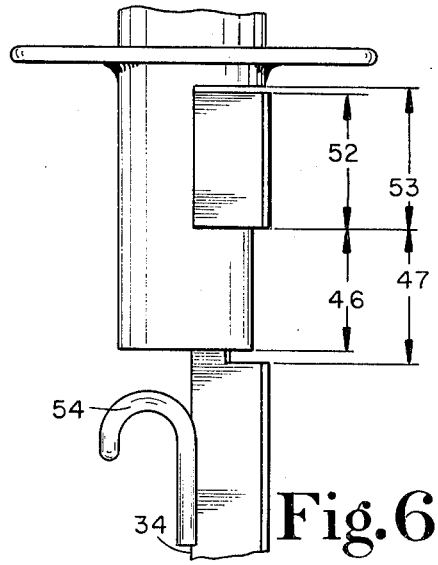
FIG. 6 is a partial side elevation of the interlocked arrangement in FIG. 5 taken along line 6—6.

Referring now to FIG. 7, the width 48 of second slot 25 is then substantially greater than that of first slot 24 so the uncut V-shaped walls 33 having a span 51 extend outwardly of tubular member 11 while interlocked therewith. The stake member can thus slide around within the inner cavity 49 of the tubular member without falling therethrough. In this regard, the length 52 of upper end 36 of the stake member is at least slightly less than the length 53 of second slot 25 to permit this interlocking relation.

Applicant's preferred stake member 32 also includes a metal hook 54 welded to the back joint 34 of the stake member for assistance with securing lines to field tents and the like.

Although not required of applicant's invention, the following is a specific example of applicant's preferred driver and extractor device and stake member and the method for using same. The dimensions, as given, are only by way of example and in no way limit the scope or breadth of applicant's invention, except to the extent so previously described and limited in this specification.

Applicant's preferred driver and extractor 10 is constructed of a steel pipe one inch in outer diameter and 20 inches long. Two washers $2\frac{1}{2}$ inches in outer diameter and $\frac{1}{8}$ inch thick are welded to this pipe to provide the striking wall projections 14 and 15, respectively. Reciprocating member 16 is a steel pipe $2\frac{1}{4}$ inches in outer diameter, 4 inches long and 7/16 inches thick positioned concentrically around the first pipe and having two identically sized washers welded to the ends thereof, but not welded to the first pipe itself. Preferred plug 28 is $\frac{3}{4}$ inches in diameter and 1 inch long and is welded inside the first pipe positioned as shown in FIG. 3. First slot 24 is cut $\frac{7}{8}$ inches long and $\frac{1}{2}$ inches wide in the lower end 13 of the first pipe. Second slot 25 is 1 inch long and 1 inch wide and connected to the first slot below the lower wall projection 15.

Preferred stake member 32 is a $\frac{3}{4}$ inch angle iron 12 inches in overall length and having a 3-inch tapered point at its lower end 35. The cut-away portions 37 in the V-shaped walls begin $\frac{3}{4}$ inch from the upper end 36, are $1\frac{3}{8}$ inches long and cut $\frac{1}{4}$ inch deep. The steel hook 54 is welded to the back joint 34 of the stake member $2\frac{1}{2}$ inches from its upper end.

With applicant's preferred driver and extractor 10 and stake member 32 thus constructed, their preferred use is as follows. Interlocking is first accomplished by positioning the stake member with one of its cut-out walls 44 adjacent to first slot 24. The remaining $\frac{1}{2}$ inch width of wall 44 at this point allows it to pass through the first slot, also $\frac{1}{2}$ inch wide, into the inner cavity 49 in tubular member 11. As this is done, the stake member or the tubular member is turned or twisted around its axis allowing the entire stake member to pass into inner cavity 49 and into the interlocking relation depicted in FIGS. 5–8. At that point, driving of the stake member is accomplished by manually striking the lower wall projection 15 with the lower surface 18 of the reciprocating member. Driving force is thereby applied to the stake member through the contact of surfaces 26 and 38 on the tubular member and stake member, respectively.

Extracting of the stake member, on the other hand, is similarly accomplished by manually striking the upper wall projection 14 with surface 17 on the reciprocating member. Extracting force is thereby applied to the stake member through the contact of surfaces 27 and 41 on the tubular member and stake member, respectively.

Once the driving or extracting operation is completed, the interlocking relation between the tubular member and the stake member is broken by a simple twisting, or turning, of the respective members, as done initially to establish the interlocking connection.

In this way, the preferred peg and stake driver and extractor of applicant's invention includes significant advantages over prior art devices which lack a stable and detachable interlocking action with the peg or stake members. By providing such an interlocking means, applicant's driver and extractor is a significant advance over the art because it is usable safely and both simply and easily in the field. Furthermore, the combination of applicant's driver and extractor and his stake member mark a futher advance over such devices, or their combinations, by providing an even more stable and efficient interlocking connection.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

We claim:

1. The combination comprising;

(a) a first elongate tubular member having an upper and a lower end thereon;

(b) a pair of striking wall projections spaced apart along the length of said first member and secured thereto;

(c) a reciprocating member positioned concentrically around said first member between said wall projections, said reciprocating member having a pair of opposing striking surfaces thereon to forcibly contact said wall projections;

(d) one end of said first member having a first longitudinal slot in the wall thereof, said first slot joined to a second longitudinal slot of substantially greater width and defining opposing horizontal contact surfaces in said first member adjacent said one end;

(e) means for interlocking the slotted end of said first member with a stake member to permit driving and extracting thereof by alternate contact between said reciprocating member and said pair of wall projections; and (f) a stake member having a lower pointed end and an upper end interlockable with the slotted end of said first member by said interlocking means, said stake member being an angle iron V-shaped in cross section and having matching cut-away portions in the V-shaped walls thereof near its upper end, said cutaway portions and the upper end thereof defining contact surfaces therein for striking said contact surfaces defined by said second slot.

2. The combination of claim 1 in which the width of said V-shaped walls having said portions cut away therefrom is greater than the width of said first slot, said interlocking means being means for passing the V-shaped walls of said stake member through said first and said second slots in the lower end of said first member with contact being alternately possible between the opposing contact surfaces defined by said second slot and the upper end of said stake member.

* * * * *